US008078456B2

(12) United States Patent
Chen et al.

(10) Patent No.: US 8,078,456 B2
(45) Date of Patent: Dec. 13, 2011

(54) AUDIO TIME SCALE MODIFICATION ALGORITHM FOR DYNAMIC PLAYBACK SPEED CONTROL

(75) Inventors: Juin-Hwey Chen, Irvine, CA (US); Robert W. Zopf, Rancho Santa Margarita, CA (US)

(73) Assignee: Broadcom Corporation, Irvine, CA (US)

( * ) Notice: Subject to any disclaimer, the term of this patent is extended or adjusted under 35 U.S.C. 154(b) by 884 days.

(21) Appl. No.: 12/119,033

(22) Filed: May 12, 2008

(65) Prior Publication Data

US 2008/0304678 A1 Dec. 11, 2008

Related U.S. Application Data

(60) Provisional application No. 60/942,408, filed on Jun. 6, 2007.

(51) Int. Cl.
*G10L 19/00* (2006.01)

(52) U.S. Cl. ..... 704/218; 704/211; 704/503

(58) Field of Classification Search ..... 704/218, 704/211, 503

See application file for complete search history.

(56) References Cited

U.S. PATENT DOCUMENTS

| | | | | |
|---|---|---|---|---|
| 5,119,373 | A * | 6/1992 | Fredricsson et al. | 370/458 |
| 6,952,668 | B1 * | 10/2005 | Kapilow | 704/206 |
| 6,999,922 | B2 * | 2/2006 | Boillot et al. | 704/216 |
| 7,047,190 | B1 * | 5/2006 | Kapilow | 704/228 |
| 7,117,156 | B1 * | 10/2006 | Kapilow | 704/267 |
| 7,143,032 | B2 * | 11/2006 | Chen | 704/228 |
| 7,233,897 | B2 * | 6/2007 | Kapilow | 704/229 |
| 7,236,927 | B2 * | 6/2007 | Chen | 704/216 |
| 7,308,406 | B2 * | 12/2007 | Chen | 704/262 |
| 7,321,851 | B2 * | 1/2008 | Andrsen et al. | 704/211 |
| 7,529,661 | B2 * | 5/2009 | Chen | 704/216 |
| 7,590,525 | B2 * | 9/2009 | Chen | 704/211 |
| 7,596,488 | B2 * | 9/2009 | Florencio et al. | 704/208 |
| 7,797,161 | B2 * | 9/2010 | Kapilow | 704/500 |
| 7,881,925 | B2 * | 2/2011 | Kapilow | 704/201 |
| 7,908,140 | B2 * | 3/2011 | Kapilow | 704/228 |
| 7,957,960 | B2 * | 6/2011 | Chen | 704/211 |
| 2003/0074197 | A1 * | 4/2003 | Chen | 704/262 |
| 2003/0177002 | A1 * | 9/2003 | Chen | 704/207 |
| 2005/0137729 | A1 * | 6/2005 | Sakurai et al. | 700/94 |
| 2005/0240402 | A1 * | 10/2005 | Kapilow | 704/229 |
| 2006/0167693 | A1 * | 7/2006 | Kapilow | 704/258 |
| 2007/0055498 | A1 * | 3/2007 | Kapilow | 704/206 |

(Continued)

OTHER PUBLICATIONS

Roucos, et al., "High Quality Time-Scale Modification for Speech", Proceedings of 1985 IEEE International Conference on Acoustic, Speech, and Signal Processing, (Mar. 1985), pp. 493-496.

*Primary Examiner* — David S. Warren

(74) *Attorney, Agent, or Firm* — Fiala & Weaver P.L.L.C.

(57) ABSTRACT

A modified synchronized overlap add (SOLA) algorithm for performing high-quality, low-complexity audio time scale modification (TSM) is described. The algorithm produces good output audio quality with a very low complexity and without producing additional audible distortion during dynamic change of the audio playback speed. The algorithm may achieve complexity reduction by performing the maximization of normalized cross-correlation using decimated signals. By updating the input buffer and the output buffer in a precise sequence with careful checking of the appropriate array bounds, the algorithm may also achieve seamless audio playback during dynamic speed change with a minimal requirement on memory usage.

30 Claims, 5 Drawing Sheets

U.S. PATENT DOCUMENTS

2007/0094031 A1* 4/2007 Chen ..... 704/267
2008/0140409 A1* 6/2008 Kapilow ..... 704/265
2008/0304678 A1* 12/2008 Chen et al. ..... 381/71.12
2009/0171656 A1* 7/2009 Kapilow ..... 704/207
2010/0274565 A1* 10/2010 Kapilow ..... 704/500
2011/0046967 A1* 2/2011 Setoguchi ..... 704/503
2011/0087489 A1* 4/2011 Kapilow ..... 704/207

* cited by examiner

AUDIO TIME SCALE MODIFICATION ALGORITHM FOR DYNAMIC PLAYBACK SPEED CONTROL

CROSS-REFERENCE TO RELATED APPLICATIONS

This application claims priority to provisional U.S. Patent Application No. 60/942,408, filed Jun. 6, 2007 and entitled "Audio Time Scale Modification Algorithm for Dynamic Playback Speed Control," the entirety of which is incorporated by reference herein.

BACKGROUND OF THE INVENTION

1. Field of the Invention

The present invention generally relates to audio time scale modification algorithms.

2. Background

In the area of digital video and digital audio technologies, it is often desirable to be able to speed up or slow down the playback of an encoded audio signal without substantially changing the pitch or timbre of the audio signal. One particular application of such time scale modification (TSM) of audio signals might include the ability to perform high-quality playback of stored video programs from a personal video recorder (PVR) at some speed that is faster than the normal playback rate. For example, in order to save some viewing time, it may be desired to play back a stored video program at a speed that is 20% faster than the normal playback rate. In this case, the audio signal needs to be played back at 1.2× speed while still maintaining high signal quality. In another example, a viewer may want to hear synchronized audio while playing back a recorded sports video program in a slow-motion mode. In yet another example, a telephone answering machine user may want to play back a recorded telephone message at a slower-than-normal speed in order to better understand the message. In each of these examples, the TSM algorithm may need to be of sufficiently low complexity such that it can be implemented in a system having limited processing resources.

One of the most popular types of audio TSM algorithms is called Synchronized Overlap-Add, or SOLA. See S. Roucos and A. M. Wilgus, "High Quality Time-Scale Modification for Speech", *Proceedings of* 1985 *IEEE International Conference on Acoustic, Speech, and Signal Processing*, pp. 493-496 (March 1985), which is incorporated by reference in its entirety herein. However, if this original SOLA algorithm is implemented "as is" for even just a single 44.1 kHz mono audio channel, the computational complexity can easily reach 100 to 200 mega-instructions per second (MIPS) on a ZSP400 digital signal processing (DSP) core (a product of LSI Logic Corporation of Milpitas, Calif.). Thus, this approach will not work for a similar DSP core that has a processing speed on the order of approximately 100 MHz. Many variations of SOLA have been proposed in the literature and some are of a reduced complexity. However, most of them are still too complex for an application scenario in which a DSP core having a processing speed of approximately 100 MHz has to perform both audio decoding and audio TSM. U.S. patent application Ser. No. 11/583,715 to Chen, entitled "Audio Time Scale Modification Using Decimation-Based Synchronized Overlap-Add Algorithm," addresses this complexity issue and describes a decimation-based approach that reduces the computational complexity of the original SOLA algorithm by approximately two orders of magnitude.

Most of the TSM algorithms in the literature, including the original SOLA algorithm and the decimation-based SOLA algorithms described in U.S. patent application Ser. No. 11/583,715, were developed with a constant playback speed in mind. If the playback speed is changed "on the fly," the output audio signal may need to be muted while the TSM algorithm is reconfigured for the new playback speed. However, in some applications, it may be desirable to be able to change the playback speed continuously on the fly, for example, by turning a speed dial or pressing a speed-change button while the audio signal is being played back. Muting the audio signal during such playback speed change will cause too many audible gaps in the audio signal. On the other hand, if the output audio signal is not muted, but the TSM algorithm is not designed to handle dynamic playback speed change, then the output audio signal may have many audible glitches, clicks, or pops.

What is needed, therefore, is a time scale modification algorithm that is capable of changing its playback speed dynamically without introducing additional audible distortion to the played back audio signal. In addition, as described above, it is desirable for such a TSM algorithm to achieve a very low level of computational complexity.

BRIEF SUMMARY OF THE INVENTION

The present invention is directed to a high-quality, low-complexity audio time scale modification (TSM) algorithm capable of speeding up or slowing down the playback of a stored audio signal without changing the pitch or timbre of the audio signal, and without introducing additional audible distortion while changing the playback speed. A TSM algorithm in accordance with an embodiment of the present invention uses a modified version of the original synchronized overlap-add (SOLA) algorithm that maintains a roughly constant computational complexity regardless of the TSM speed factor. A TSM algorithm in accordance with one embodiment of the present invention also performs most of the required SOLA computation using decimated signals, thereby reducing computational complexity by approximately two orders of magnitude.

An example implementation of an algorithm in accordance with the present invention achieves fairly high audio quality, and can be configured to have a computational complexity on the order of only 2 to 3 MIPS on a ZSP400 DSP core. In addition, one implementation of such an algorithm is also optimized for efficient memory usage as it strives to minimize the signal buffer size requirements. As a result, the memory requirement for such an algorithm can be controlled to be around 2 kilo-words per audio channel.

In particular, an example method for time scale modifying an input audio signal that includes a series of input audio signal samples is described herein. In accordance with the method, an input frame size is obtained for a next frame of the input audio signal to be time scale modified, wherein the input frame size may vary on a frame-by-frame basis. A first buffer is then shifted by a number of samples equal to the input frame size and a number of new input audio signal samples equal to the input frame size is loaded into a portion of the first buffer vacated by the shifting of the input buffer. A waveform similarity measure or a waveform difference measure is then calculated between a first portion of the input audio signal stored in the first buffer and each of a plurality of portions of an audio signal stored in a second buffer to identify a time shift. The first portion of the input audio signal stored in the first buffer is then overlap added to a portion of the audio signal stored in the second buffer and identified by the time shift to produce an overlap-added audio signal in the second buffer. A number of samples equal to a fixed output frame size are then provided from a beginning of the second buffer as a part of a time scale modified audio output signal. The second buffer is then shifted by a number of samples equal to the fixed output frame size and a second portion of the input audio signal that immediately follows the first portion of the input audio signal in the first buffer is loaded into a portion of the second buffer that immediately follows the end of the overlap-added audio signal in the second buffer after the shifting of the second buffer.

The foregoing method may further include copying a portion of the new input audio signal samples loaded into the first buffer to a tail portion of the second buffer, wherein the length of the copied portion is dependent upon a time shift associated with a previous time scale modified frame of the input audio signal.

In accordance with the foregoing method, calculating a waveform similarity measure or waveform difference measure between the first portion of the input audio signal stored in the first buffer and each of the plurality of portions of the audio signal stored in a second buffer to identify a time shift may comprise a number of steps. In accordance with these steps, the first portion of the input audio signal stored in the first buffer is decimated by a decimation factor to produce a first decimated signal segment. The portion of the audio signal stored in the second buffer is decimated by a decimation factor to produce a second decimated signal segment. A waveform similarity measure or waveform difference measure is then calculated between the first decimated signal segment and each of a plurality of portions of the second decimated signal segment to identify a time shift in a decimated domain. A time shift in an undecimated domain is then identified based on the identified time shift in the decimated domain.

A system for time scale modifying an input audio signal that includes a series of input audio signal is also described herein. The system includes a first buffer, a second buffer and time scale modification (TSM) logic communicatively connected to the first buffer and the second buffer. The TSM logic is configured to obtain an input frame size for a next frame of the input audio signal to be time scale modified, wherein the input frame size may vary on a frame-by-frame basis. The TSM logic is further configured to shift the first buffer by a number of samples equal to the input frame size and to load a number of new input audio signal samples equal to the input frame size into a portion of the first buffer vacated by the shifting of the input buffer. The TSM logic is further configured to compare a first portion of the input audio signal stored in the first buffer with each of a plurality of portions of an audio signal stored in the second buffer to identify a time shift. The TSM logic is further configured to overlap add the first portion of the input audio signal stored in the first buffer to a portion of the audio signal stored in the second buffer and identified by the time shift to produce an overlap-added audio signal in the second buffer. The TSM logic is further configured to provide a number of samples equal to a fixed output frame size from a beginning of the second buffer as a part of a time scale modified audio output signal. The TSM logic is further configured to shift the second buffer by a number of samples equal to the fixed output frame size and to load a second portion of the input audio signal that immediately follows the first portion of the input audio signal in the first buffer into a portion of the second buffer that immediately follows the end of the overlap-added audio signal in the second buffer after the shifting of the second buffer.

In accordance with the foregoing system, the TSM logic may be further configured to copy a portion of the new input audio signal samples loaded into the first buffer to a tail portion of the second buffer, wherein the length of the copied portion is dependent upon a time shift associated with a previous time scale modified frame of the input audio signal.

The TSM logic in the foregoing system may also be configured to decimate the first portion of the input audio signal stored in the first buffer by a decimation factor to produce a first decimated signal segment, to decimate a portion of the audio signal stored in the second buffer by a decimation factor to produce a second decimated signal segment, to compare the first decimated signal segment with each of a plurality of portions of the second decimated signal segment to identify a time shift in a decimated domain, and to identify a time shift in an undecimated domain based on the identified time shift in the decimated domain.

A method for time scale modifying a plurality of input audio signals, wherein each of the plurality of input audio signals is respectively associated with a different audio channel in a multi-channel audio signal, is also described herein. In accordance with the method, the plurality of input audio signals is down-mixed to provide a mixed-down audio signal. Then a time shift is identified for each frame of the mixed-down audio signal. The time shift identified for each frame of the mixed-down audio signal is then used to perform time scale modification of a corresponding frame of each of the plurality of input audio signals.

A number of steps are performed to identify a time shift for each frame of the mixed-down audio signal. First, an input frame size is obtained, wherein the input frame size may vary on a frame-by-frame basis. A first buffer is then shifted by a number of samples equal to the input frame size and a number of new mixed-down audio signal samples equal to the input frame size are loaded into a portion of the first buffer vacated by the shifting of the first buffer. A waveform similarity measure or waveform difference measure is then calculated between a first portion of the mixed-down audio signal stored in the first buffer and each of a plurality of portions of an audio signal stored in a second buffer to identify a time shift. The first portion of the mixed-down audio signal stored in the first buffer is then overlap added to a portion of the audio signal stored in the second buffer and identified by the time shift to produce an overlap-added audio signal in the second buffer. The second buffer is then shifted by a number of samples equal to a fixed output frame size and a second portion of the mixed-down audio signal that immediately follows the first portion of the mixed-down audio signal in the first buffer is loaded into a portion of the second buffer that immediately follows the end of the overlap-added audio signal in the second buffer after the shifting of the second buffer.

A system for time scale modifying a plurality of input audio signals, wherein each of the plurality of input audio signals is respectively associated with a different audio channel in a multi-channel audio signal, is also described herein. The system includes a first buffer, a second buffer and time scale modification (TSM) logic communicatively connected to the first buffer and the second buffer. The TSM logic is configured to down-mix the plurality of input audio signals to provide a mixed-down audio signal. The TSM logic is further configured to identify a time shift for each frame of the mixed-down audio signal and to use the time shift identified for each frame of the mixed-down audio signal to perform time scale modification of a corresponding frame of each of the plurality of input audio signals.

The TSM logic is configured to perform a number of operations to identify a time shift for each frame of the mixed-down audio signal. In particular, the TSM logic is configured to obtain an input frame size, wherein the input frame size may vary on a frame-by-frame basis, to shift the first buffer by a number of samples equal to the input frame size and to load a number of new mixed-down audio signal samples equal to the input frame size into a portion of the first buffer vacated by the shifting of the first buffer, to compare a first portion of the mixed-down audio signal stored in the first buffer with each of a plurality of portions of an audio signal stored in the second buffer to identify a time shift, to overlap add the first portion of the mixed-down audio signal stored in the first buffer to a portion of the audio signal stored in the second buffer and identified by the time shift to produce an overlap-added audio signal in the second buffer, and to shift the second buffer by a number of samples equal to a fixed output frame size and to load a second portion of the mixed-down audio signal that immediately follows the first portion of the mixed-down audio signal in the first buffer into a portion of the second buffer that immediately follows the end of the overlap-added audio signal in the second buffer after the shifting of the second buffer.

Further features and advantages of the present invention, as well as the structure and operation of various embodiments thereof, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
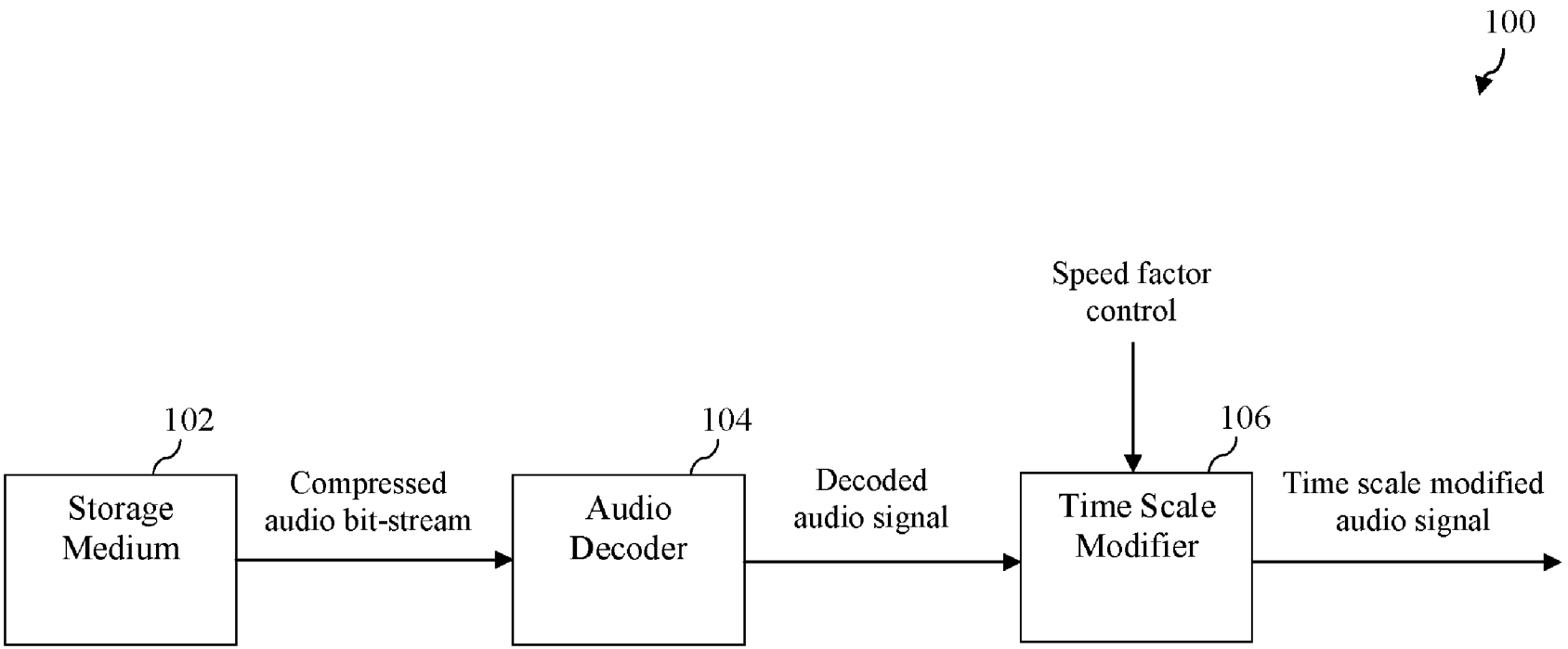
FIG. 1 illustrates an example audio decoding system that uses a time scale modification algorithm in accordance with an embodiment of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

I. Introduction

The present invention is directed to a high-quality, low-complexity audio time scale modification (TSM) algorithm capable of speeding up or slowing down the playback of a stored audio signal without changing the pitch or timbre of the audio signal, and without introducing additional audible distortion while changing the playback speed. A TSM algorithm in accordance with an embodiment of the present invention uses a modified version of the original synchronized overlap-add (SOLA) algorithm that maintains a roughly constant computational complexity regardless of the TSM speed factor. A TSM algorithm in accordance with one embodiment of the present invention also performs most of the required SOLA computation using decimated signals, thereby reducing computational complexity by approximately two orders of magnitude.

An example implementation of an algorithm in accordance with the present invention achieves fairly high audio quality, and can be configured to have a computational complexity on the order of only 2 to 3 MIPS on a ZSP400 DSP core. In addition, one implementation of such an algorithm is also optimized for efficient memory usage as it strives to minimize the signal buffer size requirements. As a result, the memory requirement for such an algorithm can be controlled to be around 2 kilo-words per audio channel.

In accordance with an embodiment of the present invention, the output frame size is fixed, while the input frame size can be varied from frame to frame to achieve dynamic change of the audio playback speed. The input signal buffer and the output signal buffer are shifted and updated in a precise sequence in relation to the optimal time shift search and the overlap-add operation, and careful checking is performed to ensure signal buffer updates will not leave any "hole" in the buffer or exceed array bounds. All of these ensure seamless audio playback during dynamic change of the audio playback speed.

In this detailed description, the basic concepts underlying some time scale modification algorithms and the issues related to quality of audio playback during dynamic change of playback speed will be described in Section II. This will be followed by a detailed description of an embodiment of a modified SOLA algorithm in accordance with the present invention in Section III. Next, in Section IV, the use of circular buffers to efficiently perform shifting operations in implementations of the present invention is described. In Section V, the application of a TSM algorithm in accordance with the present invention to stereo or general multi-channel audio signals will be described. In Section VI, an example computer system implementation of the present invention will be described. Some concluding remarks will be provided in Section VII.

II. Basic Concepts

A. Example Audio Decoding System

FIG. 1 illustrates an example audio decoding system 100 that uses a TSM algorithm in accordance with an embodiment of the present invention. In particular, and as shown in FIG. 1, example system 100 includes a storage medium 102, an audio decoder 104 and time scale modifier 106 that applies a TSM algorithm to an audio signal in accordance with an embodiment of the present invention. From the system point of view, TSM is a post-processing algorithm performed after the audio decoding operation, which is reflected in FIG. 1.

Storage medium 102 may be any medium, device or component that is capable of storing compressed audio signals. For example, storage medium 102 may comprise a hard drive of a Personal Video Recorder (PVR), although the invention is not so limited. Audio decoder 104 operates to receive a compressed audio bit-stream from storage medium 102 and to decode the audio bit-stream to generate decoded audio signal samples. By way of example, audio decoder 104 may be an AC-3, MP3, or AAC audio decoding module that decodes the compressed audio bit-stream into pulse-code modulated (PCM) audio samples. Time scale modifier 106 then processes the decoded audio samples to change the apparent playback speed without substantially altering the pitch or timbre of the audio signal. For example, in a scenario in which a 1.2× speed increase is sought, time scale modifier 106 operates such that, on average, every 1.2 seconds worth of decoded audio signal is played back in only 1.0 second. The operation of time scale modifier 106 is controlled by a speed factor control signal.

It will be readily appreciated by persons skilled in the art that the functionality of audio decoder 104 and time scale modifier 106 as described herein may be implemented as hardware, software or as a combination of hardware and software. In an embodiment of the present invention, audio decoder 104 and time scale modifier 106 are integrated components of a device, such as a PVR, that includes storage medium 102, although the invention is not so limited.

Figure 2:
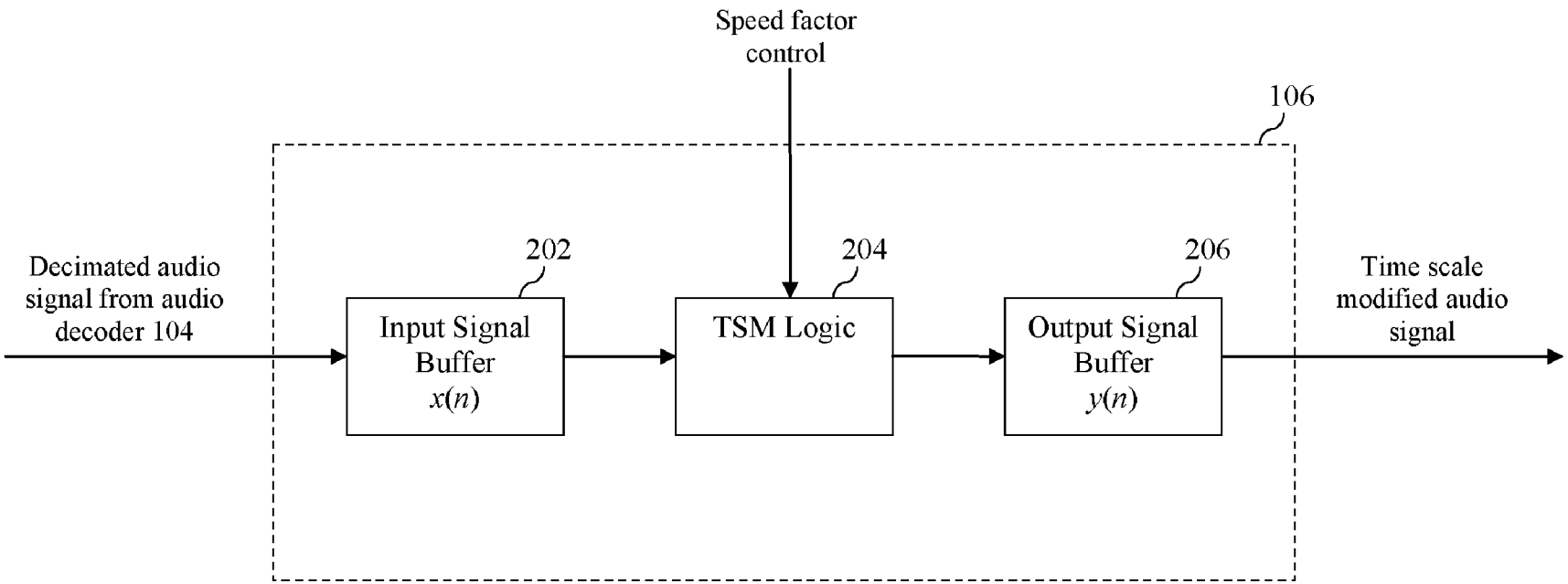
FIG. 2 illustrates an example arrangement of an input signal buffer, time scale modification logic and an output signal buffer in accordance with an embodiment of the present invention.

In one embodiment of the present invention, time scale modifier 106 includes two separate long buffers that are used by TSM logic for performing TSM operations as will be described in detail herein: an input signal buffer x(n) and an output signal buffer y(n). Such an arrangement is depicted in FIG. 2, which shows an embodiment in which time scale modifier 106 includes an input signal buffer 202, TSM logic 204, and an output signal buffer 206. In accordance with this arrangement, input signal buffer 202 contains consecutive samples of the input signal to TSM logic 204, which is also the output signal of audio decoder 104. As will be explained in more detail herein, output signal buffer 206 contains signal samples that are used to calculate the optimal time shift for the input signal before an overlap-add operation, and then after the overlap-add operation it also contains the output signal of TSM logic 204.

B. The OLA Algorithm

To understand the various modified SOLA algorithms of the present invention, it is helpful to understand the traditional SOLA method, and to understand the traditional SOLA method, it is helpful to first understand the OLA method. In OLA, a segment of waveform is extracted from an input signal at a fixed interval of once every SA samples ("SA" stands for "Size of Analysis frame"), then the extracted waveform segment is overlap-added with a waveform stored in an output buffer at a fixed interval of once every SS samples ("SS" stands for "Size of Synthesis frame"). The overlap-add result is the output signal. The parameter SA is also called the "input frame size," and the parameter SS is also called the "output frame size." The input-output timing relationship and the basic operations of the OLA algorithm are described in U.S. patent application Ser. No. 11/583,715, the entirety of which is incorporated by reference herein.

Although the OLA method is very simple and avoids waveform discontinuities, its fundamental flaw is that the input waveform is copied to the output time line and overlap-added at a rigid and fixed time interval, completely disregarding the properties of the two blocks of underlying waveforms that are being overlap-added. Without proper waveform alignment, the OLA method often leads to destructive interference between the two blocks of waveforms being overlap-added, and this causes fairly audible wobbling or tonal distortion.

C. Traditional SOLA Algorithm

Synchronized Overlap-Add (SOLA) solves the foregoing problem by copying the input waveform block to the output time line not at a fixed time interval like OLA, but at a location near where OLA would copy it to, with the optimal location (or optimal time shift from the OLA location) chosen to maximize some sort of waveform similarity measure between the two blocks of waveforms to be overlap-added. Equivalently, the optimal location may be chosen to minimize some sort of waveform difference measure between the two blocks of waveforms to be overlap-added. Since the two waveforms being overlap-added are maximally similar, destructive interference is greatly minimized, and the resulting output audio quality can be very high, especially for pure voice signals. This is especially true for speed factors close to 1, in which case the SOLA output voice signal sounds completely natural and essentially distortion-free.

There exist many possible waveform similarity measures or waveform difference measures that can be used to judge the degree of similarity or difference between two waveform segments. A common example of a waveform similarity measure is the so-called "normalized cross correlation," which is defined herein in Section III. Another example is cross-correlation without normalization. A common example of a waveform difference measure is the so-called Average Magnitude Difference Function (AMDF), which was often used in some of the early pitch extraction algorithms and is well-known by persons skilled in the relevant art(s). By maximizing a waveform similarity measure, or equivalently, minimizing a waveform difference measure, one can find an optimal time shift that corresponds to a maximum similarity or minimum difference between two waveform segments. Using this time shift, the two waveform segments can be overlapped and added in a manner that minimizes destructive interference or partial waveform cancellation.

For convenience of discussion, in the rest of this document only normalized cross-correlation will be mentioned in describing example embodiments of the present invention. However, persons skilled in the art will readily appreciate that similar results and benefits may be obtained by simply substituting another waveform similarity measure for the normalized cross-correlation, or by replacing it with a waveform difference measure and then reversing the direction of optimization (from maximizing to minimizing). Thus, the description of normalized cross-correlation in this document should be regarded as an example only and is not limiting.

In U.S. patent application Ser. No. 11/583,715, the entirety of which has been incorporated by reference herein, the input-output timing relationship of the traditional SOLA algorithm is illustrated in a graphical example, and the basic operations of the traditional SOLA algorithm are described.

D. Decimation-Based SOLA Algorithm (DSOLA)

In a traditional SOLA approach, nearly all of the computational complexity is in the search for the optimal time shift. As discussed above, the complexity of traditional SOLA may be too high for a system having limited processing resources, and great reduction of the complexity may thus be needed for a practical implementation.

U.S. patent application Ser. No. 11/583,715 provides a detailed description of a modified SOLA algorithm in which an optimal time shift search is performed using decimated signals to reduce the complexity by roughly two orders of magnitude. The reduction is achieved by calculating the normalized cross-correlation values using a decimated (i.e. down-sampled) version of the output buffer and an input template block in the input buffer. Suppose the output buffer is decimated by a factor of 10, and the input template block is also decimated by a factor of 10. Then, when one searches for the optimal time shift in the decimated domain, one has approximately 10 times fewer normalized cross-correlation values to evaluate, and each cross-correlation has 10 times fewer samples involved in the inner product. Therefore, one can reduce the associated computational complexity by a factor of 10×10=100. The final optimal time shift is obtained by multiplying the optimal time shift in the decimated domain by the decimation factor of 10.

Of course, the resulting optimal time shift of the foregoing approach has only one-tenth the time resolution of SOLA. However, it has been observed that the output audio quality is not very sensitive to this loss of time resolution.

If one wished, one could perform a refinement time shift search in the undecimated time domain in the neighborhood of the coarser optimal time shift. However, this will significantly increase the computational complexity of the algorithm (easily double or triple), and the resulting audio quality improvement is not very noticeable. Therefore, it is not clear such a refinement search is worthwhile.

Another issue with such a Decimation-based SOLA (DSOLA) algorithm is how the decimation is performed. Classic text-book examples teach that one needs to do proper lowpass filtering before down-sampling to avoid aliasing distortion. However, even with a highly efficient third-order elliptic filter, the lowpass filtering requires even more computational complexity than the normalized cross-correlation in the decimation-by-10 example above. It has been observed that direct decimation without lowpass filtering results in output audio quality that is just as good as with lowpass filtering. For this reason, in a modified SOLA algorithm in accordance with an embodiment of the present invention, direct decimation is performed without lowpass filtering.

Another benefit of direct decimation without lowpass filtering is that the resulting algorithm can handle pure tone signals with tone frequency above half of the sampling rate of the decimated signal. If one implements a good lowpass filter with high attenuation in the stop band before one decimates, then such high-frequency tone signals will be mostly filtered out by the lowpass filter, and there will not be much left in the decimated signal for the search of the optimal time shift. Therefore, it is expected that applying lowpass filtering can cause significant problems for pure tone signals with tone frequency above half of the sampling rate of the decimated signal. In contrast, direct decimation will cause the high-frequency tones to be aliased back to the base band, and a SOLA algorithm with direct decimation without lowpass filtering works fine for the vast majority of the tone frequencies, all the way up to half the sampling rate of the original undecimated input signal.

E. Time Scale Modification with Seamless Playback During Dynamic Change of Playback Speed The TSM algorithms described above were developed for a given constant playback speed. Dynamic change of the playback speed was generally not a design consideration when these algorithms were developed. If one wants to dynamically change the playback speed on a frame-by-frame basis, then these algorithms are likely to produce audible distortion during the transition period associated with the speed change.

What an embodiment of the present invention attempts to achieve is a constant playback speed within each output frame (which may be for example 10 ms to 20 ms long) while allowing the playback speed to change when transitioning between any two adjacent output frames. In other words, in the worst case the playback speed may change at every output frame boundary. The goal is to keep the corresponding output audio signal smooth-sounding (seamless) without any audible glitches, clicks, or pops across the output frame boundaries, and keep the computational complexity and memory requirement low while achieving such seamless playback during dynamic speed change.

An embodiment of the present invention is a modified version of a SOLA algorithm described in U.S. patent application Ser. No. 11/583,715 that achieves this goal. In particular, an embodiment of the present invention achieves this goal by modifying some of the input/output buffer update steps of a memory-efficient SOLA algorithm described in U.S. patent application Ser. No. 11/583,715 to take into account the possibility of a changing playback speed.

The playback speed factor β is the output playback speed divided by the input playback speed, which is equivalent to the input frame size (SA) divided by the output frame size (SS), that is, β=SA/SS. In the modified SOLA algorithm described in U.S. patent application Ser. No. 11/583,715, the output frame size SS is fixed. In light of this constraint, the only way to change the playback speed is to change the input frame size SA.

With reference to FIG. 2, the ability to dynamically alter the playback speed on a frame-by-frame basis is achieved by supplying TSM logic 204 with a new speed factor control value every frame. If this speed factor control value at frame k is provided as the speed factor β(k), then TSM logic 204 computes the input frame size for frame k as SA(k)=round (β(k)·SS) samples, where round(·) is a function that rounds off a number to its nearest integer, before processing frame k. Alternatively, SA(k), the input frame size for frame k, can be directly provided to the TSM logic 204 on a frame-by-frame basis to achieve dynamic playback speed control.

III. Detailed Description of a Modified SOLA Algorithm in Accordance with an Embodiment of the Present Invention In this section, a modified SOLA algorithm in accordance with the present invention will be described in detail. The algorithm is capable of seamless playback during dynamic change of playback speed, and at the same time achieves the same low computational complexity and low memory usage as a memory-efficient SOLA algorithm described in U.S. patent application Ser. No. 11/583,715.

In the algorithm description below, SA is the input frame size, SS is the output frame size, L is the length of the optimal time shift search range, WS is the window size of the sliding window for cross-correlation calculation, which is also the overlap-add window size, and DECF is the decimation factor used for obtaining the decimated signal for the optimal time shift search in the decimated domain. Normally the parameters WS and L are chosen such that WSD=WS/DECF and LD=L/DECF are both integers. Let the variable speed factor be in a range of $[\beta_{min}, \beta_{max}]$ Then, the possible values of the input frame size SA will be in a range of [SA_min, SA_max], where SA_min=round($\beta_{min}$·SS), and SA_max=round ($\beta_{max}$·SS).

The input buffer x=[x(1), x(2), . . . x(LX)] is a vector with LX samples, and the output buffer y=[y(1), y(2), . . . , y(LY)] is another vector with LY samples. The input buffer size LX is chosen to be the larger of SA_max and (WS+L+SS−SA_min). The output buffer size is LY=WS+L.

For ease of description, the following description will make use of the standard Matlab® vector index notation, where x(j:k) means a vector containing the j-th element through the k-th element of the x array. Specifically, x(j:k)= [x(j), x(j+1), x(j+2), . . . , x(k−1), x(k)]. Also, for convenience, the following description assumes the use of linear buffers with sample shifting. However, persons skilled in the art will appreciate that the various sample shifting operations described herein can be performed by implementing equivalent operations using circular buffers.

Figure 3:
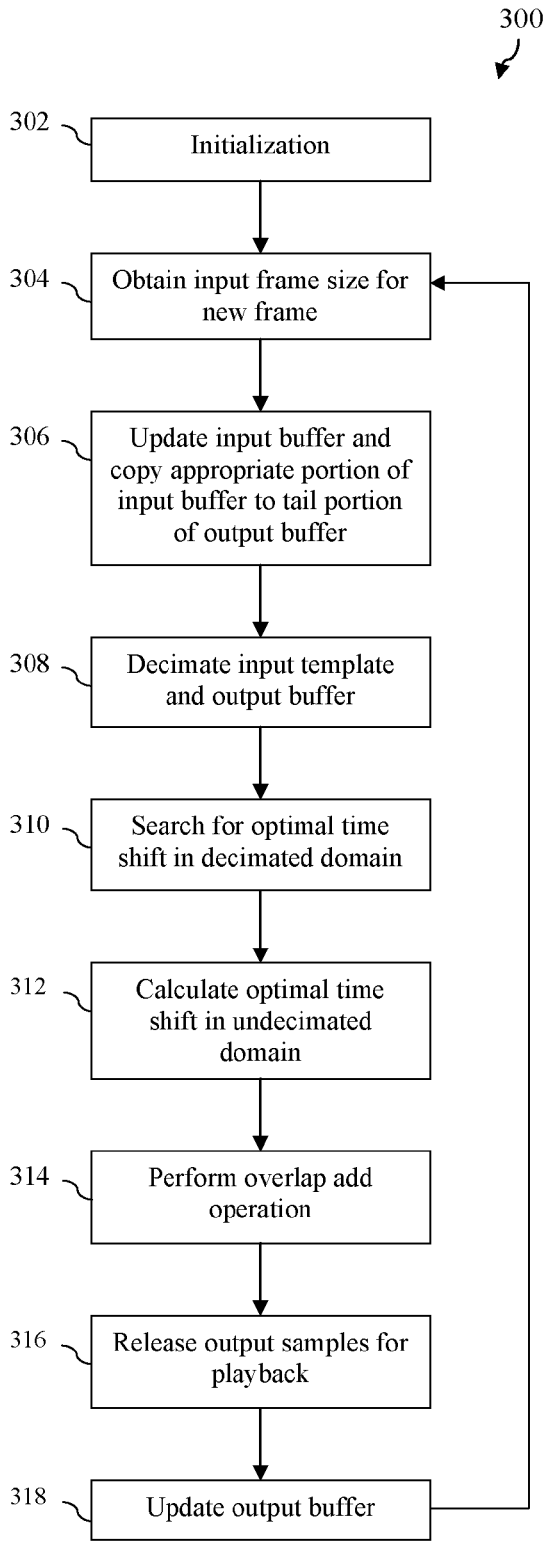
FIG. 3 depicts a flowchart of a modified SOLA algorithm in accordance with an embodiment of the present invention.

One example of this algorithm will now be described in detail below. At a high level, the steps performed are illustrated in flowchart 300 of FIG. 3. Note that this example algorithm is described by way of example only and is not intended to limit the present invention.

1. Initialization (step 302): At the start of the algorithm, the input buffer x array and the output buffer y array are both initialized to zero arrays, and the optimal time shift is initialized to kopt=0. After this initialization, the algorithm enters a loop starting from the next step.

2. Obtain the input frame size SA for the new frame (step 304): This SA may be directly provided to the TSM algorithm by the system in response to the user input for the audio playback speed control. If the system controls the TSM algorithm output playback speed by providing the speed factor β(k) for every frame, then the TSM algorithm may calculate the input frame size as SA=round(β(k)·SS).

3. Update the input buffer and copy appropriate portion of input buffer to the tail portion of the output buffer (step 306): Shift the input buffer x by SA samples, i.e., x(1:LX−SA)=x(SA+1:LX), and then fill the portion of the input buffer vacated by the shift x(LX−SA+1:LX) with SA new input audio signal samples (the current input frame). This completes the input buffer update.

Next, an appropriate portion of the SA new input audio signal samples loaded into the input buffer may be copied to a tail portion of the output buffer, wherein the length of the copied portion is dependent upon the optimal time shift kopt associated with the previously-processed frame, as described below.

Calculate the length of the portion of x to copy: len=LY−LX+SS−kopt If len>0, do the next two indented lines: If len>SA, then set len=SA.

```
y(kopt+LX−SS+1:kopt+LX−SS+len)=x(LX−SA+1:
    LX−SA+len)
```

4. Decimate the input template and output buffer (step 308): The input template used for the optimal time shift search is the first WS samples of the input buffer, or x(1:WS). This input template is directly decimated to obtain the decimated input template xd(1: WSD)=[x(DECF), x(2×DECF), x(3×DECF), . . . , x(WSD×DECF)], where DECF is the decimation factor, and WSD is the window size in the decimated signal domain. Normally WS=WSD×DECF. Similarly, the entire output buffer is also decimated to obtain yd(1:WSD+LD)=[y(DECF), y(2×DECF), y(3×DECF), . . . , y(2×(WSD+LD)×DECF)]. Note that if the memory size is really constrained, one does not need to explicitly set aside memory for the xd and yd arrays when searching for the optimal time shift in the next step; instead, one can directly index the x and y arrays using indices that are multiples of DECF, perhaps at the cost of increased number of instruction cycles used.

5. Search for optimal time shift in decimated domain between 0 and LD (step 310): For a given time shift k, the waveform similarity measure is the normalized cross-correlation defined as $$R(k) = \frac{\sum_{n=1}^{WSD} xd(n)yd(n+k)}{\sqrt{\sum_{n=1}^{WSD} xd^2(n) \sum_{n=1}^{WSD} yd^2(n+k)}},$$

where R(k) can be either positive or negative. To avoid the square-root operation, it is noted that finding the k that maximizes R(k) is equivalent to finding the k that maximizes $$Q(k) = \text{sign}(R(k)) \times R^2(k) = \text{sign}\left(\sum_{n=1}^{WSD} xd(n)yd(n+k)\right) \times \frac{\left[\sum_{n=1}^{WSD} xd(n)yd(n+k)\right]^2}{\sum_{n=1}^{WSD} xd^2(n) \sum_{n=1}^{WSD} yd^2(n+k)}$$

where $$\text{sign}(x) = \begin{cases} 1, & \text{if } x \geq 0 \\ -1, & \text{if } x < 0 \end{cases}.$$

Furthermore, since $$\sum_{n=1}^{WSD} xd^2(n),$$

which is the energy of the decimated input template, is independent of the time shift k, finding k that maximizes Q(k) is also equivalent to finding k that maximizes $$P(k) = \text{sign}\left(\sum_{n=1}^{WSD} xd(n)yd(n+k)\right) \times \frac{\left[\sum_{n=1}^{WSD} xd(n)yd(n+k)\right]^2}{\sum_{n=1}^{WSD} yd^2(n+k)} = \frac{c(k)}{e(k)},$$

where $$c(k) = \text{sign}\left(\sum_{n=1}^{WSD} xd(n)yd(n+k)\right)\left[\sum_{n=1}^{WSD} xd(n)yd(n+k)\right]^2$$

and $$e(k) = \sum_{n=1}^{WSD} yd^2(n+k).$$

To avoid the division operation in $$\frac{c(k)}{e(k)},$$

which may be very inefficient in a DSP core, it is further noted that finding the k between 0 and LD that maximizes P(k) involves making LD comparison tests in the form of testing whether P(k)>P(j), or whether $$\frac{c(k)}{e(k)} > \frac{c(j)}{e(j)},$$

but this is equivalent to testing whether c(k)e(j)>c(j)e(k). Thus, the so-called "cross-multiply" technique may be used in an embodiment of the present invention to avoid the division operation. In addition, an embodiment of the present invention may calculate the energy term e(k) recursively to save computation. This is achieved by first calculating $$e(0) = \sum_{n=1}^{WSD} yd^2(n)$$

using WSD multiply-accumulate (MAC) operations. Then, for k from 1, 2, . . . to LD, each new e(k) is recursively calculated as $e(k)=e(k-1)-yd^2(k)+yd^2(WSD+k)$ using only two MAC operations. With all this algorithm background introduced above, the algorithm to search for the optimal time shift in the decimated signal domain can now be described as follows.

5.a. Calculate $Ey = \sum_{n=1}^{WSD} yd^2(n)$ 5.b. Calculate $cor = \sum_{n=1}^{WSD} xd(n)yd(n)$ 5.c. If cor>0, set cor2opt=cor×cor; otherwise, set cor2opt=−cor×cor.

5.d. Set Eyopt=Ey and set koptd=0.

5.e. For k from 1, 2, 3, . . . to LD, do the following indented part:

5.e.i. Calculate

Ey=Ey−yd(k)×yd(k)+yd(WSD+k)×yd(WSD+k).

5.e.ii. Calculate $cor = \sum_{n=1}^{WSD} xd(n)yd(n+k)$.

5.e.iii. If cor>0, set cor2=cor×cor; otherwise, set cor2=−cor×cor.

5.e.iv. If cor2×Eyopt>cor2opt×Ey, then reset koptd=k, Eyopt=Ey, and cor2opt=cor2

5.f. When the algorithm execution reaches here, the final koptd is the optimal time shift in the decimated signal domain.

6. Calculate optimal time shift in undecimated domain (step 312): The optimal time shift in the undecimated signal domain kopt is calculated by multiplying the optimal time shift in the decimated signal domain koptd by the decimation factor DECF:

kopt=DECF×koptd.

7. Perform overlap-add operation (step 314): If the program size is not constrained, using raised cosine as the fade-out and fade-in windows is recommended:

Fade-out window:

$$w_o(n) = 0.5 \times \left[1 + \cos\left(\frac{n\pi}{WS+1}\right)\right],$$

for $n = 1,2,3, \ldots, WS$.

Fade-in window: $w_i(n)=1-w_o(n)$, for n=1, 2, 3, . . . , WS. Note that only one of the two windows above need to be stored as a data table. The other one can be obtained by indexing the first table from the other end in the opposite direction. If it is desirable not to store any of such windows, then one can use triangular windows and calculate the window values "on-the-fly" by adding a constant term with each new sample. The overlap-add operation is performed "in place" by overwriting the portion of the output buffer with the index range of 1+kopt to WS+kopt, as described below:

For n from 1, 2, 3, . . . to WS, do the next indented line:

$y(n+kopt)=w_o(n)y(n+kopt)+w_i(n)x(n)$.

8. Release output samples for play back (step 316): When the algorithm execution reaches here, the current frame of output samples stored in y(1:SS) are released for audio playback. These output samples should be copied to another output playback buffer before they are overwritten in the next step.

9. Update the output buffer (step 318): To prepare for the next frame, the output buffer is updated as follows.

9.a. Shift the portion of the output buffer up to the end of the overlap-add period by SS samples as follows.

y(1:WS−SS+kopt)=y(SS+1:WS+kopt).

9.b. Further update the portion of the output buffer right after the portion updated in step 9.a. above by copying the appropriate portion of the input buffer as follows. The portion of the input buffer that is copied immediately follows the input template portion of the input buffer.

If kopt+LX−SS<LY, do the next indented line:

y(WS−SS+kopt+1:LX−SS+kopt)=x(WS+1:LX).

Otherwise, do the next indented line:

y(WS−SS+kopt+1:LY)=x(WS+1:LY+SS−kopt).

10. Return to Step 2 above to process next frame.

IV. The Use of Circular Buffers to Efficiently Perform Shifting Operations

As can be seen in the algorithm described in the preceding section, the updating of the input buffer and the output buffer involves shifting a portion of the older samples by a certain number of samples. For example, Step 3 of the algorithm involves shifting the input buffer x by SA samples such that x(1:LX−SA)=x(SA+1:LX).

When the input and output buffers are implemented as linear buffers, such shifting operations involve data copying and can take a large number of processor cycles. However, most modern digital signal processors (DSPs), including the ZSP400, have built-in hardware to accelerate the "modulo" indexing required to support a so-called "circular buffer." As will be appreciated by persons skilled in the art, most DSPs today can perform modulo indexing without incurring cycle overhead. When such DSPs are used to implement circular buffers, then the sample shifting operations mentioned above can be performed much more efficiently, thus saving a considerable number of DSP instruction cycles.

The way a circular buffer works should be well known to those skilled in the art. However, an explanation is provided below for the sake of completeness. Take the input buffer x(1:LX) as an example. A linear buffer is just an array of LX samples. A circular buffer is also an array of LX samples. However, instead of having a definite beginning x(1) and a definite end x(LX) as in the linear buffer, a circular buffer is logically like a linear buffer that is curled around to make a circle, with x(LX) "bent" and placed right next to x(1). The way a circular buffer works is that each time this circular buffer array x(:) is indexed, the index is always put through a "modulo LX" operation, where LX is the length of the circular buffer. There is also a variable pointer that points to the "beginning" of the circular buffer, where the beginning changes with each new frame. For each new frame, this pointer is advanced by N samples, where N is the frame size.

A more specific example will help to understand how a circular buffer works. In Step 3 above, x(SA+1:LX) is copied to x(1:LX−SA). In other words, the last LX−SA samples are shifted by SA samples so that they occupy the first LX−SA samples. Using a linear buffer, that requires LX−SA memory read operations and LX−SA memory write operations. Then, the last SA samples of the input buffer, or x(LX−SA+1:LX) are filled by SA new input audio PCM samples from an input audio file. In contrast, when a circular buffer is used, the LX−SA read operations and LX−SA write operations can all be avoided. The pointer p (that points to the "beginning" of the circular buffer) is simply incremented by SA, modulo LX; that is, p=modulo(p+SA, LX). This achieves shifting of those last LX−SA samples of the frame by SA samples. Then, based on this incremented new pointer value p (and the corresponding new beginning and end of the circular buffer), the last SA samples of the "current" circular buffer are simply filled by SA new input audio PCM samples from the input audio file. Again, when the circular buffer is indexed to copy these SA new input samples, the index needs to go through the modulo LX operation.

A DSP such as the ZSP400 can support two independent circular buffers in parallel with zero overhead for the modulo indexing. This is sufficient for the input buffer and the output buffer of the SOLA algorithm presented in the preceding section. Therefore, all the sample shifting operations in that algorithm can be performed very efficiently if the input and output buffers are implemented as circular buffers using the ZSP400's built-in support for circular buffers. This will save a large number of ZSP400 instruction cycles.

V. Applying TSM to Stereo and Multi-Channel Audio

When applying a TSM algorithm to a stereo audio signal or even an audio signal with more than two channels, an issue arises: if TSM is applied to each channel independently, in general the optimal time shift will be different for different channels. This will alter the phase relationship between the audio signals in different channels, which results in greatly distorted stereo image or sound stage in general. This problem is inherent to any TSM algorithm, be it traditional SOLA, the modified SOLA algorithm described herein, or anything else.

Figure 4:
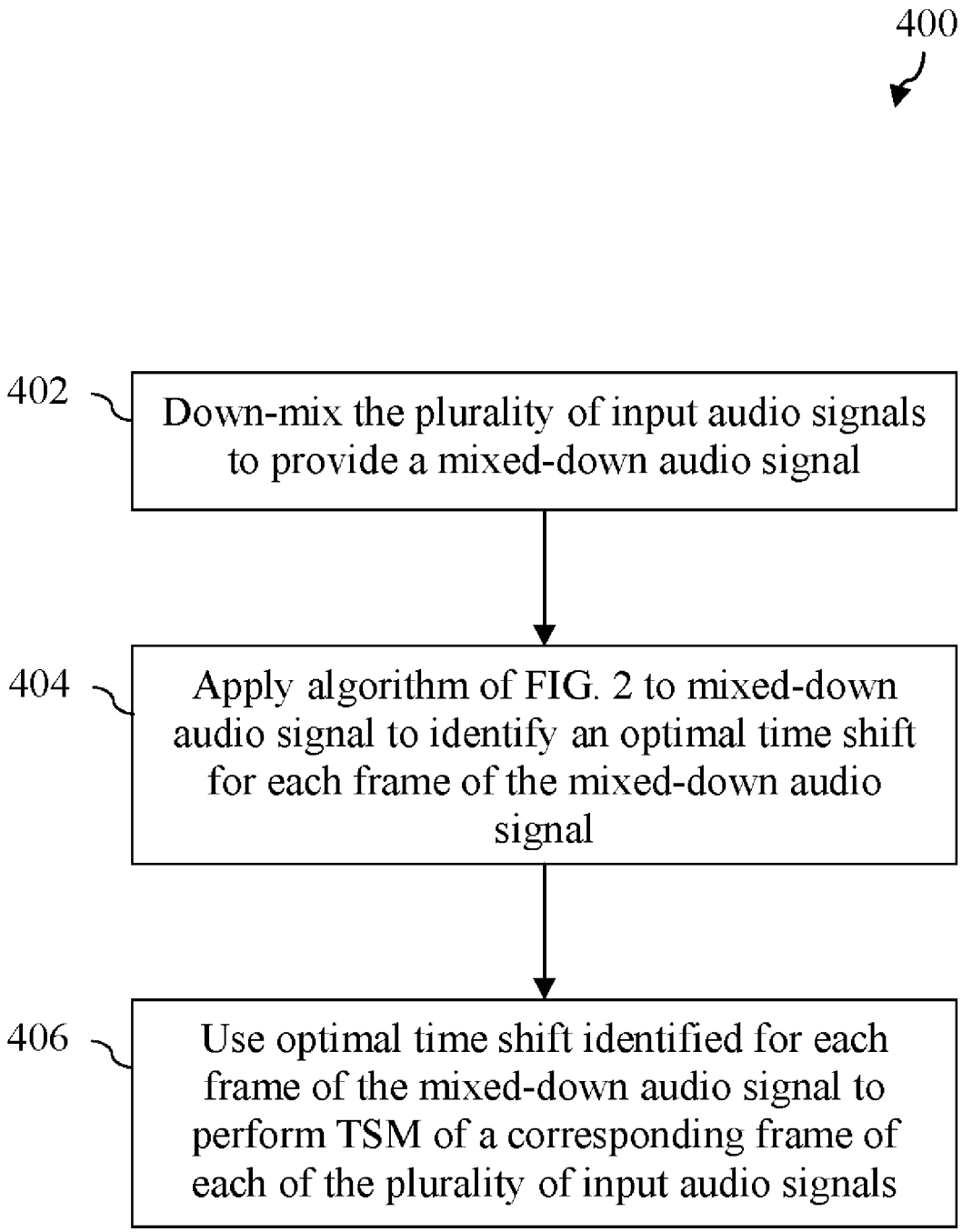
FIG. 4 depicts a flowchart of a method for applying time scale modification (TSM) to a multi-channel audio signal in accordance with an embodiment of the present invention.

A solution in accordance with the present invention is to down-mix the audio signals respectively associated with the different audio channels to produce a single mixed-down audio signal. The mixed-down audio signal may be calculated as a weighted sum of the plurality of audio signals. Then, the algorithm described in Section III is applied to the mixed-down audio signal to obtain an optimal time shift for each frame of the mixed-down audio signal. The algorithm would be modified in that no output samples would be released for playback. The optimal time shift obtained for each frame of the mixed-down audio signal is then used to perform time scale modification of a corresponding frame of each of the plurality of input audio signals. This general approach is depicted in flowchart 400 of FIG. 4. The final step may be performed by applying the processing steps of the algorithm described in Section III to each audio signal corresponding to a different audio channel, except that the optimal time shift search is skipped and the optimal time shift obtained from the mixed-down audio signal is used instead. Since the audio signals in all audio channels are time-shifted by the same amount, the phase relationship between them is preserved, and the stereo image or sound stage is kept intact.

VI. Example Computer System Implementation

Figure 5:
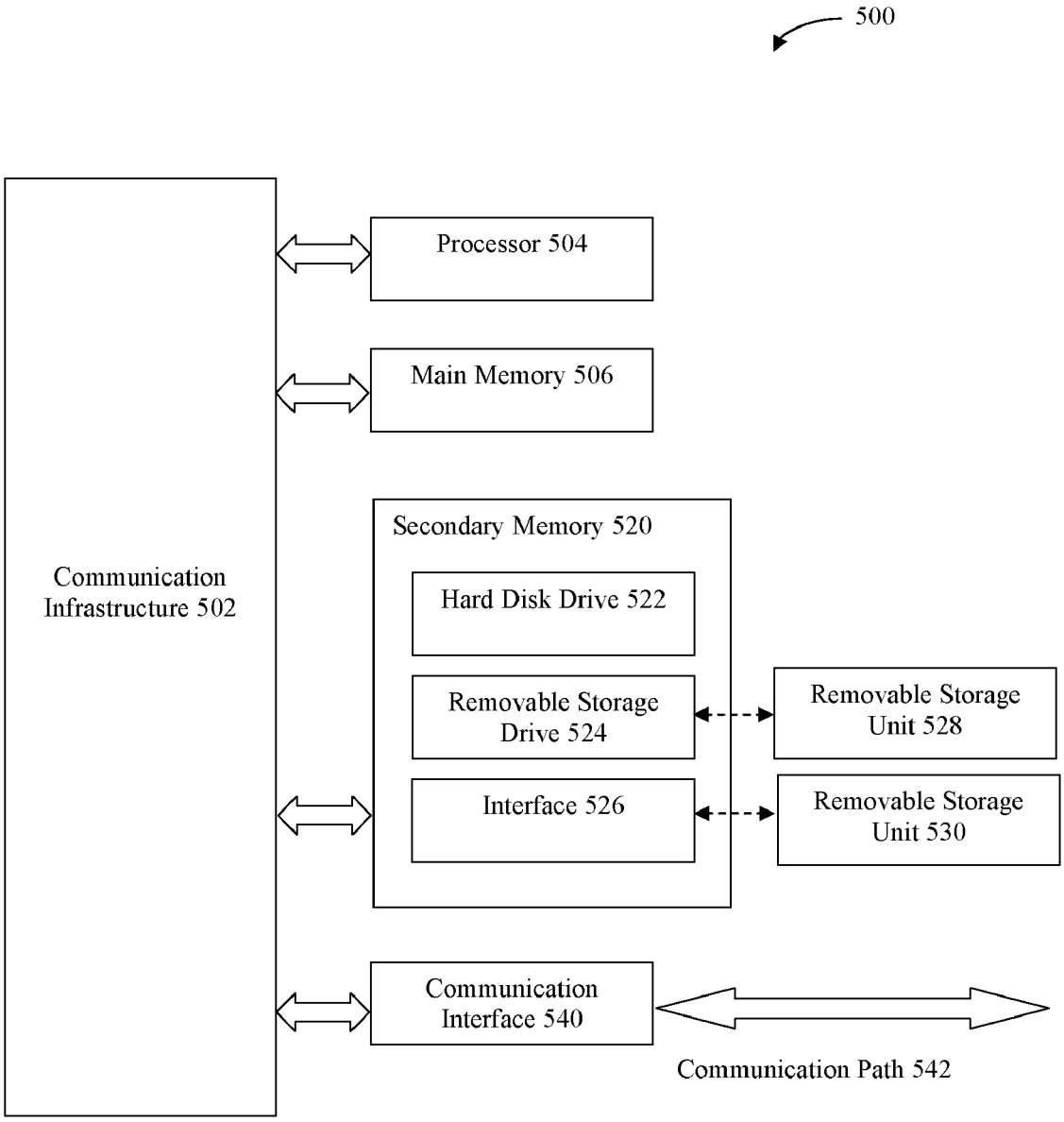
FIG. 5 is a block diagram of an example computer system that may be configured to perform a TSM method in accordance with an embodiment of the present invention.

The following description of a general purpose computer system is provided for the sake of completeness. The present invention can be implemented in hardware, or as a combination of software and hardware. Consequently, the invention may be implemented in the environment of a computer system or other processing system. An example of such a computer system 500 is shown in FIG. 5. In the present invention, all of the signal processing blocks depicted in FIGS. 1 and 2, for example, can execute on one or more distinct computer systems 500, to implement the various methods of the present invention.

Computer system 500 includes one or more processors, such as processor 504. Processor 504 can be a special purpose or a general purpose digital signal processor. Processor 504 is connected to a communication infrastructure 502 (for example, a bus or network). Various software implementations are described in terms of this exemplary computer system. After reading this description, it will become apparent to a person skilled in the relevant art(s) how to implement the invention using other computer systems and/or computer architectures.

Computer system 500 also includes a main memory 506, preferably random access memory (RAM), and may also include a secondary memory 520. Secondary memory 520 may include, for example, a hard disk drive 522 and/or a removable storage drive 524, representing a floppy disk drive, a magnetic tape drive, an optical disk drive, or the like. Removable storage drive 524 reads from and/or writes to a removable storage unit 528 in a well known manner. Removable storage unit 528 represents a floppy disk, magnetic tape, optical disk, or the like, which is read by and written to by removable storage drive 524. As will be appreciated by persons skilled in the relevant art(s), removable storage unit 528 includes a computer usable storage medium having stored therein computer software and/or data.

In alternative implementations, secondary memory 520 may include other similar means for allowing computer programs or other instructions to be loaded into computer system 500. Such means may include, for example, a removable storage unit 530 and an interface 526. Examples of such means may include a program cartridge and cartridge interface (such as that found in video game devices), a removable memory chip (such as an EPROM, or PROM) and associated socket, and other removable storage units 530 and interfaces 526 which allow software and data to be transferred from removable storage unit 530 to computer system 500.

Computer system 500 may also include a communications interface 540. Communications interface 540 allows software and data to be transferred between computer system 500 and external devices. Examples of communications interface 540 may include a modem, a network interface (such as an Ethernet card), a communications port, a PCMCIA slot and card, etc. Software and data transferred via communications interface 540 are in the form of signals which may be electronic, electromagnetic, optical, or other signals capable of being received by communications interface 540. These signals are provided to communications interface 540 via a communications path 542. Communications path 542 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 528 and 530 or a hard disk installed in hard disk drive 522. These computer program products are means for providing software to computer system 500.

Computer programs (also called computer control logic) are stored in main memory 506 and/or secondary memory 520. Computer programs may also be received via communications interface 540. Such computer programs, when executed, enable the computer system 500 to implement the present invention as discussed herein. In particular, the computer programs, when executed, enable processor 500 to implement the processes of the present invention, such as any of the methods described herein. Accordingly, such computer programs represent controllers of the computer system 500. Where the invention is implemented using software, the software may be stored in a computer program product and loaded into computer system 500 using removable storage drive 524, interface 526, or communications interface 540.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

VII. CONCLUSION

The foregoing provided a detailed description a modified SOLA algorithm in accordance with one embodiment of the present invention that produces fairly good output audio quality with a very low complexity and without producing additional audible distortion during dynamic change of the audio playback speed. This modified SOLA algorithm may achieve complexity reduction by performing the maximization of normalized cross-correlation using decimated signals. By updating the input buffer and the output buffer in a precise sequence with careful checking of the appropriate array bounds, this algorithm may also achieve seamless audio playback during dynamic speed change with a minimal requirement on RAM memory usage. With its good audio quality and low complexity, this modified SOLA algorithm is well-suited for use in audio speed up application for PVRs.

While various embodiments of the present invention have been described above, it should be understood that they have been presented by way of example only, and not limitation. It will be understood by those skilled in the relevant art(s) that various changes in form and details may be made therein without departing from the spirit and scope of the invention as defined in the appended claims. Accordingly, the breadth and scope of the present invention should not be limited by any of the above-described exemplary embodiments, but should be defined only in accordance with the following claims and their equivalents.

We claim:

1. A method for time scale modifying an input audio signal that includes a series of input audio signal samples, comprising:

obtaining an input frame size for a next frame of the input audio signal to be time scale modified, wherein the input frame size may vary on a frame-by-frame basis;

shifting a first buffer by a number of samples equal to the input frame size and loading a number of new input audio signal samples equal to the input frame size into a portion of the first buffer vacated by the shifting of the input buffer;

calculating a waveform similarity measure or waveform difference measure between a first portion of the input audio signal stored in the first buffer and each of a plurality of portions of an audio signal stored in a second buffer to identify a time shift;

overlap adding the first portion of the input audio signal stored in the first buffer to a portion of the audio signal stored in the second buffer and identified by the time shift to produce an overlap-added audio signal in the second buffer;

providing a number of samples equal to a fixed output frame size from a beginning of the second buffer as a part of a time scale modified audio output signal; and shifting the second buffer by a number of samples equal to the fixed output frame size and loading a second portion of the input audio signal that immediately follows the first portion of the input audio signal in the first buffer into a portion of the second buffer that immediately follows the end of the overlap-added audio signal in the second buffer after the shifting of the second buffer.

2. The method of claim 1, wherein obtaining the input frame size comprises:

obtaining a playback speed factor for the next frame of the input audio signal to be time scale modified, wherein the playback speed factor may vary on a frame-by-frame basis; and calculating the input frame size based on the playback speed factor.

3. The method of claim 2, wherein calculating the input frame size based on the playback speed factor comprises:

multiplying the playback speed factor by the fixed output frame size and rounding the result of the multiplication to a nearest integer.

4. The method of claim 1, further comprising:

copying a portion of the new input audio signal samples loaded into the first buffer to a tail portion of the second buffer, wherein the length of the copied portion is dependent upon a time shift associated with a previous time scale modified frame of the input audio signal.

5. The method of claim 1, wherein calculating a waveform similarity measure or waveform difference measure between a first portion of the input audio signal stored in the first buffer and each of a plurality of portions of an audio signal stored in a second buffer to identify a time shift comprises:

decimating the first portion of the input audio signal stored in the first buffer by a decimation factor to produce a first decimated signal segment;

decimating a portion of the audio signal stored in the second buffer by a decimation factor to produce a second decimated signal segment;

calculating a waveform similarity measure or waveform difference measure between the first decimated signal segment and each of a plurality of portions of the second decimated signal segment to identify a time shift in a decimated domain; and identifying a time shift in an undecimated domain based on the identified time shift in the decimated domain.

6. The method of claim 5, wherein calculating the waveform similarity measure or waveform difference measure between the first decimated signal segment and each of a plurality of portions of the second decimated signal segment comprises:

performing a normalized cross correlation between the first decimated signal segment and each of the plurality of portions of the second decimated signal segment.

7. The method of claim 5, wherein identifying a time shift in an undecimated domain based on the identified time shift in the decimated domain comprises:

multiplying the identified time shift in the decimated domain by the decimation factor.

8. The method of claim 7, wherein identifying a time shift in an undecimated domain based on the identified time shift in the decimated domain further comprises:

identifying the result of the multiplication as a coarse time shift; and performing a refinement time shift search around the coarse time shift in the undecimated domain.

9. The method of claim 5, wherein decimating the first portion of the input audio signal stored in the first buffer and decimating the portion of the audio signal stored in the second buffer comprises:

decimating the first portion of the input audio signal stored in the first buffer and decimating the portion of the audio signal stored in the second buffer without first low-pass filtering either the first portion of the input audio signal stored in the first buffer or the portion of the audio signal stored in the second buffer.

10. The method of claim 1, wherein overlap adding the first portion of the input audio signal stored in the first buffer to a portion of the audio signal stored in the second buffer and identified by the time shift comprises:

multiplying the first portion of the input audio signal stored in the first buffer by a fade-in window to produce a first windowed portion;

multiplying the portion of the audio signal stored in the second buffer and identified by the time shift by a fade-out window to produce a second windowed portion; and adding the first windowed portion and the second windowed portion.

11. The method of claim 1, wherein at least one of the first buffer and the second buffer is a linear buffer.

12. The method of claim 1, wherein at least one of the first buffer and the second buffer is a circular buffer.

13. A system for time scale modifying an input audio signal that includes a series of input audio signal samples, comprising:

a first buffer;

a second buffer; and time scale modification (TSM) logic communicatively connected to the first buffer and the second buffer;

wherein the TSM logic is configured to obtain an input frame size for a next frame of the input audio signal to be time scale modified, wherein the input frame size may vary on a frame-by-frame basis;

wherein the TSM logic is further configured to shift the first buffer by a number of samples equal to the input frame size and to load a number of new input audio signal samples equal to the input frame size into a portion of the first buffer vacated by the shifting of the input buffer;

wherein the TSM logic is further configured to compare a first portion of the input audio signal stored in the first buffer with each of a plurality of portions of an audio signal stored in the second buffer to identify a time shift;

wherein the TSM logic is further configured to overlap add the first portion of the input audio signal stored in the first buffer to a portion of the audio signal stored in the second buffer and identified by the time shift to produce an overlap-added audio signal in the second buffer;

wherein the TSM logic is further configured to provide a number of samples equal to a fixed output frame size from a beginning of the second buffer as a part of a time scale modified audio output signal; and wherein the TSM logic is further configured to shift the second buffer by a number of samples equal to the fixed output frame size and to load a second portion of the input audio signal that immediately follows the first portion of the input audio signal in the first buffer into a portion of the second buffer that immediately follows the end of the overlap-added audio signal in the second buffer after the shifting of the second buffer.

14. The system of claim 13, wherein the TSM logic is configured to compare the first portion of the input audio signal stored in the first buffer with each of the plurality of portions of the audio signal stored in the second buffer by calculating a waveform similarity measure between the first portion of the input audio signal stored in the first buffer and each of the plurality of portions of the audio signal stored in the second buffer.

15. The system of claim 13, wherein the TSM logic is configured to compare the first portion of the input audio signal stored in the first buffer with each of the plurality of portions of the audio signal stored in the second buffer by calculating a waveform difference measure between the first portion of the input audio signal stored in the first buffer and each of the plurality of portions of the audio signal stored in the second buffer.

16. The system of claim 13, wherein the TSM logic is configured to obtain a playback speed factor for the next frame of the input audio signal to be time scale modified, wherein the playback speed factor may vary on a frame-by-frame basis, and to calculate the input frame size based on the playback speed factor.

17. The system of claim 16, wherein the TSM logic is configured to multiply the playback speed factor by the fixed output frame size and to round the result of the multiplication to a nearest integer to calculate the input frame size.

18. The system of claim 13, wherein the TSM logic is further configured to copy a portion of the new input audio signal samples loaded into the first buffer to a tail portion of the second buffer, wherein the length of the copied portion is dependent upon a time shift associated with a previous time scale modified frame of the input audio signal.

19. The system of claim 13, wherein the TSM logic is configured to decimate the first portion of the input audio signal stored in the first buffer by a decimation factor to produce a first decimated signal segment, to decimate a portion of the audio signal stored in the second buffer by a decimation factor to produce a second decimated signal segment, to compare the first decimated signal segment with each of a plurality of portions of the second decimated signal segment to identify a time shift in a decimated domain, and to identify a time shift in an undecimated domain based on the identified time shift in the decimated domain.

20. The system of claim 19, wherein the TSM logic is configured to compare the first decimated signal segment with each of a plurality of portions of the second decimated signal segment by performing a normalized cross correlation between the first decimated signal segment and each of the plurality of portions of the second decimated signal segment.

21. The system of claim 19, wherein the TSM logic is configured to multiply the identified time shift in the decimated domain by the decimation factor to identify the time shift in the undecimated domain.

22. The system of claim 21, wherein the TSM logic is further configured to identify the result of the multiplication as a coarse time shift and to performing a refinement time shift search around the coarse time shift in the undecimated domain to identify the time shift in the undecimated domain.

23. The system of claim 19, wherein the TSM logic is configured to decimate the first portion of the input audio signal stored in the first buffer and to decimate the portion of the audio signal stored in the second buffer without first low-pass filtering either the first portion of the input audio signal stored in the first buffer or the portion of the audio signal stored in the second buffer.

24. The system of claim 13, wherein the TSM logic is configured to multiply the first portion of the input audio signal stored in the first buffer by a fade-in window to produce a first windowed portion, to multiply the portion of the audio signal stored in the second buffer and identified by the time shift by a fade-out window to produce a second windowed portion, and to add the first windowed portion and the second windowed portion.

25. The system of claim 13, wherein at least one of the first buffer and the second buffer is a linear buffer.

26. The system of claim 13, wherein at least one of the first buffer and the second buffer is a circular buffer.

27. A method for time scale modifying a plurality of input audio signals, wherein each of the plurality of input audio signals is respectively associated with a different audio channel in a multi-channel audio signal, comprising:

down-mixing the plurality of input audio signals to provide a mixed-down audio signal;

for each frame of the mixed-down audio signal:

obtaining an input frame size, wherein the input frame size may vary on a frame-by-frame basis, shifting a first buffer by a number of samples equal to the input frame size and loading a number of new mixed-down audio signal samples equal to the input frame size into a portion of the first buffer vacated by the shifting of the first buffer, calculating a waveform similarity measure or waveform difference measure between a first portion of the mixed-down audio signal stored in the first buffer and each of a plurality of portions of an audio signal stored in a second buffer to identify a time shift, overlap adding the first portion of the mixed-down audio signal stored in the first buffer to a portion of the audio signal stored in the second buffer and identified by the time shift to produce an overlap-added audio signal in the second buffer, and shifting the second buffer by a number of samples equal to a fixed output frame size and loading a second portion of the mixed-down audio signal that immediately follows the first portion of the mixed-down audio signal in the first buffer into a portion of the second buffer that immediately follows the end of the overlap-added audio signal in the second buffer after the shifting of the second buffer; and using each time shift identified for each frame of the mixed-down audio signal to perform time scale modification of a corresponding frame of each of the plurality of input audio signals.

28. The method of claim 27, wherein down-mixing the plurality of audio signals comprises calculating a weighted sum of the plurality of audio signals.

29. A system for time scale modifying a plurality of input audio signals, wherein each of the plurality of input audio signals is respectively associated with a different audio channel in a multi-channel audio signal, comprising:

a first buffer;

a second buffer; and time scale modification (TSM) logic communicatively connected to the first buffer and the second buffer;

wherein the TSM logic is configured to down-mix the plurality of input audio signals to provide a mixed-down audio signal;

wherein the TSM logic is further configured, for each frame of the mixed-down audio signal, to obtain an input frame size, wherein the input frame size may vary on a frame-by-frame basis, to shift the first buffer by a number of samples equal to the input frame size and to load a number of new mixed-down audio signal samples equal to the input frame size into a portion of the first buffer vacated by the shifting of the first buffer, to compare a first portion of the mixed-down audio signal stored in the first buffer with each of a plurality of portions of an audio signal stored in the second buffer to identify a time shift, to overlap add the first portion of the mixed-down audio signal stored in the first buffer to a portion of the audio signal stored in the second buffer and identified by the time shift to produce an overlap-added audio signal in the second buffer, and to shift the second buffer by a number of samples equal to a fixed output frame size and to load a second portion of the mixed-down audio signal that immediately follows the first portion of the mixed-down audio signal in the first buffer into a portion of the second buffer that immediately follows the end of the overlap-added audio signal in the second buffer after the shifting of the second buffer; and wherein the TSM logic is further configured to use each time shift identified for each frame of the mixed-down audio signal to perform time scale modification of a corresponding frame of each of the plurality of input audio signals.

30. The system of claim 29, wherein the TSM logic is configured to down-mix the plurality of audio signals by calculating a weighted sum of the plurality of audio signals.

* * * * *